US009290879B2

(12) United States Patent
Lee et al.

(10) Patent No.: US 9,290,879 B2
(45) Date of Patent: Mar. 22, 2016

(54) WASHING MACHINE AND CONTROLLING METHOD

(75) Inventors: Bo Ram Lee, Yongin-si (KR); Hyun Sook Kim, Suwon-si (KR); Sang Yeon Pyo, Suwon-si (KR); Eun Suk Bang, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1869 days.

(21) Appl. No.: 12/081,027

(22) Filed: Apr. 9, 2008

(65) Prior Publication Data

US 2009/0064421 A1 Mar. 12, 2009

(30) Foreign Application Priority Data

Sep. 7, 2007 (KR) ..... 10-2007-0091091

(51) Int. Cl.
*D06F 33/00* (2006.01)
*D06F 35/00* (2006.01)

(52) U.S. Cl.
CPC ..... *D06F 35/004* (2013.01); *D06F 35/00* (2013.01)

(58) Field of Classification Search
CPC ..... D06F 35/004
See application file for complete search history.

(56) References Cited

U.S. PATENT DOCUMENTS

| | | | | |
|---|---|---|---|---|
| 6,041,626 | A | 3/2000 | Jung | |
| 8,181,297 | B2 * | 5/2012 | Lee | 8/149.1 |
| 2005/0034491 | A1 * | 2/2005 | Tazawa et al. | 68/12.03 |
| 2008/0099052 | A1 * | 5/2008 | Lee et al. | 134/18 |

FOREIGN PATENT DOCUMENTS

| | | | | |
|---|---|---|---|---|
| EP | 0 086 935 | A2 | 8/1983 | |
| JP | 2001-198392 | | 7/2001 | |
| JP | 2005-124767 | | 5/2005 | |
| KR | 20-0153251 | | 8/1999 | |
| KR | 10-2005-0097755 | | 10/2005 | |
| WO | WO2006/101372 | A1 * | 3/2006 | D06F 35/00 |
| WO | 2008/155272 | A1 | 12/2008 | |

OTHER PUBLICATIONS

Korean Office Action dated Feb. 21, 2012 issued in corresponding Korean Patent Application No. 10-2007-0091091.
Extended European Search Report dated May 7, 2015 in corresponding European Patent Application No. 08154533.7, 7 pages.

* cited by examiner

*Primary Examiner* — Michael Barr
*Assistant Examiner* — Jason Riggleman
(74) *Attorney, Agent, or Firm* — Staas & Halsey LLP

(57) ABSTRACT

A washing machine and a controlling method are provided for maintaining an optimal temperature for efficient generation of foam to perform foam washing in washing laundry. The controlling method for the washing machine includes supplying washing water with detergent required to generate foam, generating foam using detergent water which is a mixture of the washing water and the detergent, transmitting heat to the generated foam by heating the detergent water, and washing laundry using the foam.

12 Claims, 4 Drawing Sheets

WASHING MACHINE AND CONTROLLING METHOD

CROSS-REFERENCE TO RELATED APPLICATIONS

This application claims the benefit of Korean Patent Application No. 10-2007-91091, filed on Sep. 7, 2007, in the Korean Intellectual Property Office, the disclosure of which is incorporated herein by reference.

BACKGROUND

1. Field

The present invention relates to a washing machine and a controlling method thereof. More particularly, the present invention relates to a washing machine and a controlling method thereof, capable of maintaining an optimal temperature for efficient generation of foam to perform foam washing that uses a large amount of foam in washing laundry, thereby accomplishing optimal washing efficiency.

2. Description of the Related Art

Generally, washing machines, especially drum-type washing machines, comprise a water tub to reserve detergent water or rinsing water therein, a cylindrical drum mounted rotatably in the water tub to receive laundry to be washed (hereinafter, referred to merely as "laundry"), and a motor to generate a driving force for rotating the drum. As the drum rotates, the laundry put in the drum repeats rising and falling along an inner wall of the drum, thereby being washed.

For this, such a washing machine performs a series of operation cycles including a washing cycle to separate dirt of the laundry by washing water containing detergent in solution, a rinsing cycle to rinse off foam and residual detergent from the laundry by rinsing water not containing detergent, and a dehydrating cycle to remove water from the washed laundry quickly. In the washing cycle, upon users' selection of a washing course, weight of the laundry is detected and an amount of washing water to be used is accordingly determined. Therefore, a proper amount of washing water to soak the laundry is put in the water tub together with detergent. The washing water containing detergent is distributed over the laundry by rotation of the drum, and the laundry is washed as rising and falling in the drum.

However, when using such a conventional washing machine, even a space between the water tub and the drum, as well as the inside of the drum, needs to be filled with the washing water. As a result, consumption of the water and the detergent increases. Heat washing presents further problems, as much energy is required to heat up the increased amount of supplied water.

In addition, a head by rotation of the drum and friction by water may seriously damage laundry of delicate cloths, such as silk, which require delicate washing.

SUMMARY

One or more embodiments of the present invention have been made in order to solve the above problems. It is an aspect of one or more embodiments of the present invention to provide a washing machine and a controlling method thereof, capable of reducing consumption of water by performing foam washing, while improving a washing efficiency using high-concentration detergent foam.

Another aspect of one or more embodiments of the present invention is to provide a washing machine and a controlling method thereof, capable of maintaining an optimal water temperature for efficient generation of foam by alternately performing foaming and heating during foam washing of laundry, so that the temperature is fully transmitted to the foam and accordingly the washing efficiency is optimized.

Additional aspects and/or advantages will be set forth in part in the description which follows and, in part, will be apparent from the description, or may be learned by practice of the invention.

Consistent with the above aspects, an exemplary embodiment of the present invention provides a controlling method for a washing machine, comprising supplying washing water with detergent required to generate foam, generating foam using detergent water which is a mixture of the washing water and the detergent, transmitting heat to the generated foam by heating the detergent water, and washing laundry by the foam.

The foam generating may comprise heating the detergent water which is the mixture of the washing water and the detergent, and operating a foaming device to generate foam when the heated detergent water reaches a preset first temperature.

The detergent water heating may be performed by continuously heating the detergent water up to the first temperature by operating a heating device.

The foaming device operating may comprise setting a foaming operation rate according to the weight of the laundry, and controlling an on/off operation of the foaming device in accordance with the set foaming operation rate to thereby generate foam.

The heat transmitting may be performed by operating a heating device alternately with the foaming device.

The washing by foam may comprise heating the detergent water by alternately operating the foaming device and the heating device, and washing the laundry by transmitting heat of the detergent water to the generated foam until the heated detergent water reaches a preset second temperature.

When the detergent water reaches the second temperature, the heating device may be stopped and foam washing is performed only by the foaming device.

The second temperature may be higher than the first temperature.

The controlling method may further comprise detecting a water level of the detergent water heated by the alternate operations of the foaming device and the heating device.

Washing of the laundry may be performed by continuing the heat transmission to the generated foam through the alternate operations of the foaming device and the heating device until the water level of the detergent water reaches a heater-safe water level for operation of the heating device, thereby washing the laundry.

When the detergent water reaches the heater-safe water level, the heating device may be stopped and the foam washing is performed only by the foaming device.

The first temperature may be in the range of about 25~35° C. at which foam is efficiently generated.

Further consistent with the above aspects of the present invention, an exemplary embodiment of the present invention provides a washing machine comprising a water supply device, a foaming device, a heating device, and a control unit which controls the water supply device to supply washing water and detergent, controls the foaming device to generate foam from detergent water which is a mixture of the washing water and the detergent, controls the heating device to heat the detergent water and transmit heat of the detergent water to the generated foam, and performs washing of laundry using foam heated by the heat of the detergent water, wherein the control unit transmits heat of the detergent water to the generated foam by operating the heating device when the foaming device is off.

The control unit may detect weight of the laundry to accordingly determine an operation rate of the foaming device, and controls an on/off operation of the foaming device to generate foam.

The control unit may operate the heating device alternately with the on/off operation of the foaming device so as to transmit the heat of the detergent water to the generated foam.

The washing machine may further comprise a water level sensor to detect a water level of the detergent water, and then the control unit may transmits the heat of the detergent water to the generated foam by alternately operating the foaming device and the heating device until the detergent water reaches a safe water level for safe operation of the heating device.

When the detergent water reaches a heater-safe water level at which the heating device is submerged, the control unit may stop the heating device so that foam washing is performed only by the foaming device.

The washing machine may further comprise a temperature sensor that detects the temperature of the detergent water, and then the control unit alternately may operate the foaming device and the heating device until the detergent water reaches a preset second temperature, so as to transmit the heat of the detergent water to the generated foam.

When the detergent water reaches the second temperature, the control unit may stop the heating device so that the foam washing is performed only by the foaming device.

The control unit may stop the heating device when the foaming device is operating, and the heating device may be operated when the foaming device is stopped.

Other embodiments of the present invention may also include a method of machine washing including generating foam from a mixture of detergent and washing water, heating the generated foam by heating the mixture to a selected temperature with, maintaining a mixture level that allows generation of foam and safe heating, and washing the laundry with the foam.

The generating, heating, maintaining and washing may be controlled in synchronization.

The controlling may further comprise evaluating sensed water level and temperature information.

The washed laundry may be dried after washing.

Other embodiments may include a controlling method for a washing machine including supplying detergent water in a space between a water tub and a drum, intermittently heating the detergent water, forcibly generating foam using the detergent water, and washing laundry with the foam.

The heating of the detergent water may be performed until the detergent water reaches a preset temperature.

The heating of the detergent water may be stopped when the detergent water reaches a heater safe water level operation of the heating device.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
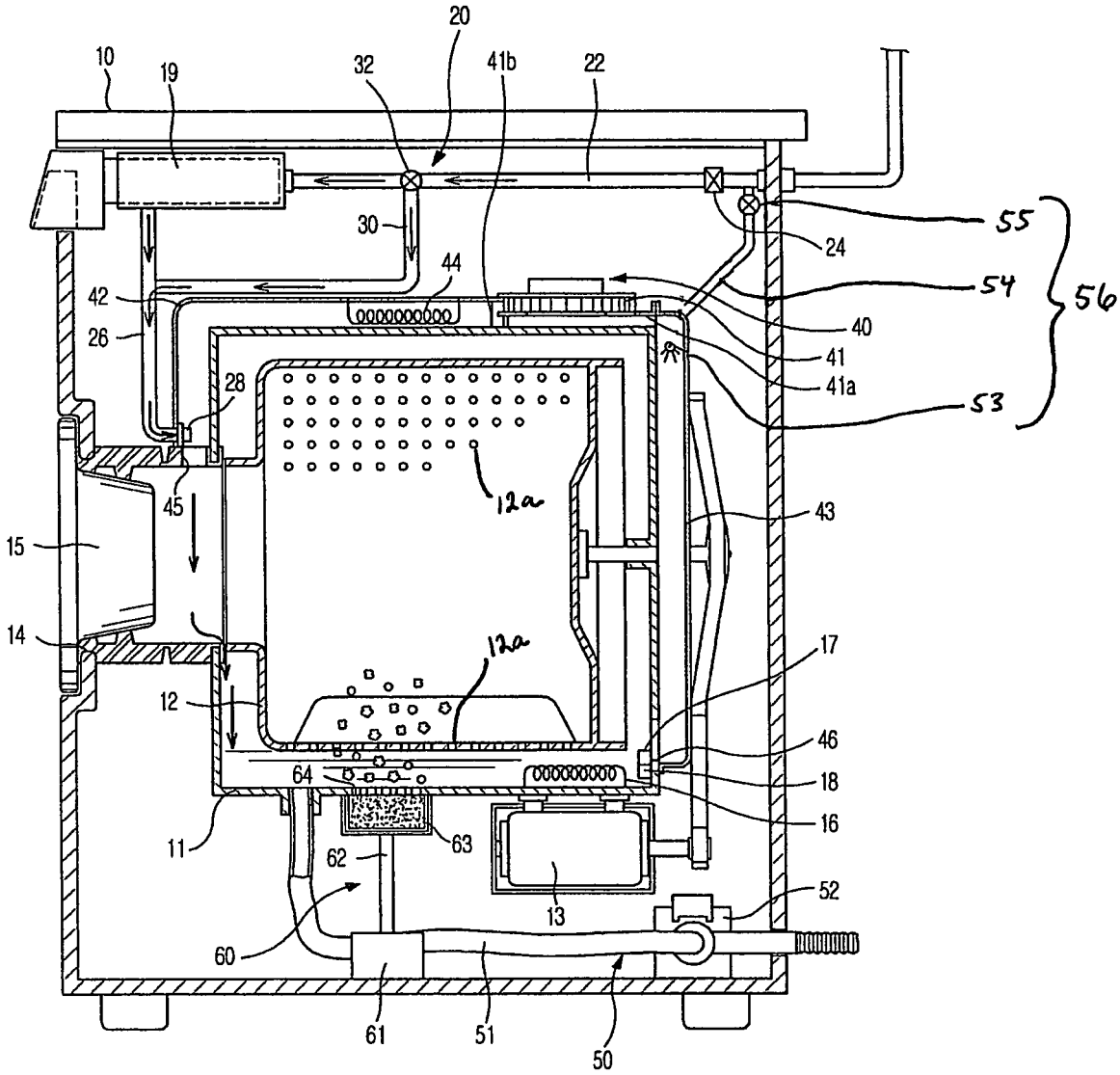
FIG. 1 is a sectional view of a washing machine according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a sectional view of a washing machine according to an embodiment of the present invention.

Referring to FIG. 1, a washing machine which uses foam, comprises a main body 10, a drum-type water tub 11 mounted in the main body 10, and a rotary drum 12 mounted rotatably in the water tub 11 and furnished with a plurality of dehydrating holes 12*a*.

A motor 13 is mounted to a lower part of the water tub 11 to rotate the rotary drum 12 forward and backward to thereby perform washing, rinsing and dehydrating. An opening 14 is formed at a front side of the water tub 11 and the rotary drum 12 to enable a user to put in and take out laundry from the front of the main body 10. Additionally, a door 15 is mounted at the front of the main body 10 to open and close the opening 14.

The water tub 11 includes, at an inner lower part thereof, a washing heater 16 to heat up washing water, which contains detergent, supplied into the water tub 11 in accordance with a user-selected temperature, a water level sensor 17 to detect frequency varied according to a water level to thereby measure the washing water or detergent water supplied in the water tub 11, and a temperature sensor 18 to detect temperature of the washing water or the detergent water (hereinafter, referred to as 'water temperature') supplied in the water tub 11.

The water level sensor 17 controls a water level between a first water level, being an optimal water level for generation of foam in a desired amount without overflowing foam into the rotary drum 12 containing laundry to be washed therein, and a second water level, being a minimal water level for generation of foam and also being a heater-safe water level, providing an amount of water to submerge only the washing heater 16. More specifically, when the detergent water supplied for the foam washing reaches the first water level, the water level sensor 17 interrupts the supplying of the detergent water so that the detergent water does not overflow into the rotary drum 12. When the detergent water decreases to the second water level, the water level sensor 17 stops operation of the washing heater 16.

Further, the water level sensor 17 continuously detects the water level, in addition to the first and second water levels, to maintain the water level which enables foam generation while preventing the detergent water from reaching the laundry. Additionally, during the foam washing, the water level sensor 17 measures any reduced degree of the water level through flux control and time control, thereby monitoring water level conditions to effectively control the amount of the supplied washing water necessary for foam generation.

The temperature sensor 18 controls the water temperature between a first temperature at which foam is efficiently generated and a second temperature which is the maximum ideal temperature aimed to improve heat transmission efficiency of the foam. In other words, the second temperature is the highest water temperature used to heat the foam, being higher than the first temperature by a certain degree. When the water temperature reaches the first temperature during the foam washing, the temperature sensor 18 functions so that a foaming operation and a heating operation by the washing heater 16 are alternately performed, accordingly improving the heat transmission efficiency of the foam into the laundry. Here, the washing heater 16 is driven while the foaming operation is not performed, that is, while an air pump 61 mounted under the water tub 11 is stopped. Further, the washing heater 16 is stopped during the foaming operation, that is, while the air pump 61 is operating.

As the alternate foaming operation and heating operation are repeated, the water temperature increases. When the water temperature reaches the second temperature, the operation of the washing heater 16 is stopped.

The water tub 11 includes, at an upper part thereof, a detergent supply device 19 that supplies detergent, and a water supply device 20 that supplies the washing water. An inside of the detergent supply device 19 is partitioned into a plurality of sections and located at the front side of the main body 10 for the user to conveniently put the detergent and rinsing conditioner in the respective sections. The water supply device 20 includes a water supply pipe 22 supplying the washing water therethrough, and a water supply valve 24 mounted to the water supply pipe 22 to control the water supply of the water supply pipe 22. The water supply pipe 22 is connected with the detergent supply device 19 so that the water from the outside can be supplied to the detergent supply device 19.

A connection pipe 26 is dedicatedly provided between the detergent supply device 19 and the water tub 11 such that the washing water passed through the detergent supply device 19 can be supplied to the water tub 11 along with the detergent. A water supply nozzle 28 is mounted to an outlet of the connection pipe 26. Through this structure, a high-concentration detergent water to generate foam at a space between the water tub 11 and the rotary drum 12 can be produced by supplying the detergent from the detergent supply device 19 into the water tub 11 together with the washing water.

The water supply device 20 further includes an assistant water supply pipe 30 connected with water supply pipe 22 to further supply the washing water for soaking the laundry before the foaming operation or the washing water for generation of foam when the water level is reduced due to the foaming operation. The water supply device 20 also includes an assistant water supply valve 32 which controls the supply of washing water toward the water tub 11, being mounted to the assistant water supply pipe 30. The assistant water supply pipe 30 is connected to the connection pipe 26 so that the water supplied through the water supply pipe 22 can be supplied directly to the water tub 11 without passing through the detergent supply device 19.

The assistant water supply valve 32 is implemented by a three-directional valve capable of controlling the washing water supplied through the water supply pipe 22 to be directed to the detergent supply device 19 or the assistant water supply pipe 30.

The washing machine according to the embodiment of the present invention also includes a drying device 40 drying the washed laundry. The drying device 40 comprises a drying fan 41 mounted at an upper part of the water tub 11, a drying duct 42 interconnecting an exhaust outlet 41*b* of the drying fan 41 and an air inlet 45 formed at an upper part of the opening 14 of the water tub 11, and a condensing duct 43 mounted to the rear part of the water tub 11 to interconnect an air outlet 46 formed at a rear lower part of the water tub 11 and a suction inlet 41*a* of the drying fan 41.

The drying device 40 further comprises a drying heater 44 mounted in the drying duct 42 to supply hot air into the water tub 11, and a condensing device 56 provided to the condensing duct 43. The condensing device 56 removes moisture condensed from wet steam generated when drying the laundry and passed through the condensing duct 43. More particularly, the condensing device 56 is mounted to an inner upper part of the condensing duct 43, comprising a coolant jet nozzle 53 jetting coolant into the condensing duct 43, and a coolant supply pipe 54 and a coolant valve 55 which are connected to the water supply device 20 to supply coolant to the coolant jet nozzle 53. The above-structured condensing device 56 induces the coolant jetted from the coolant jet nozzle 53 to flow down to the lower part along an inside of the condensing duct 43 so that contact between the coolant and wet air rising from the lower part is enhanced, thereby improving dehumidifying efficiency.

Additionally, a drainage device 50 is provided to drain water in the water tub 11. The drainage device 50 comprises a drain pipe 51 connected to the lower part of the water tub 11 to guide the water in the water tub 11 to the outside, and a drain pump 52 mounted to the drain pipe 51.

The washing machine further includes a foaming device 60 which generates foam for washing the laundry put in the rotary drum 12. The foaming device 60 comprises the air pump 61 mounted under the water tub 11 to supply air, an air supply pipe 62 transferring the air supplied from the air pump 61, and a porous block 63 having a number of fine holes to distribute the air as mounted to an end of the air supply pipe 62.

The porous block 63 is in close contact with a bottom surface of the water tub 11 by an opened upper part thereof. Since the bottom surface of the water tub 11 in contact with the porous block 63 has a plurality of air holes 64, the air supplied from the air pump 61 is passed through the air supply pipe 62 and the porous block 63, and thereby distributed. The distributed air flows into the space between the water tub 11 and the rotary drum 12 and generates air bubbles in the detergent water, accordingly generating detergent foam, which passes into the rotary drum 12 through holes 12*a*. As a consequence, the laundry in the rotary drum 12 can be washed by only the foam.

Figure 2:
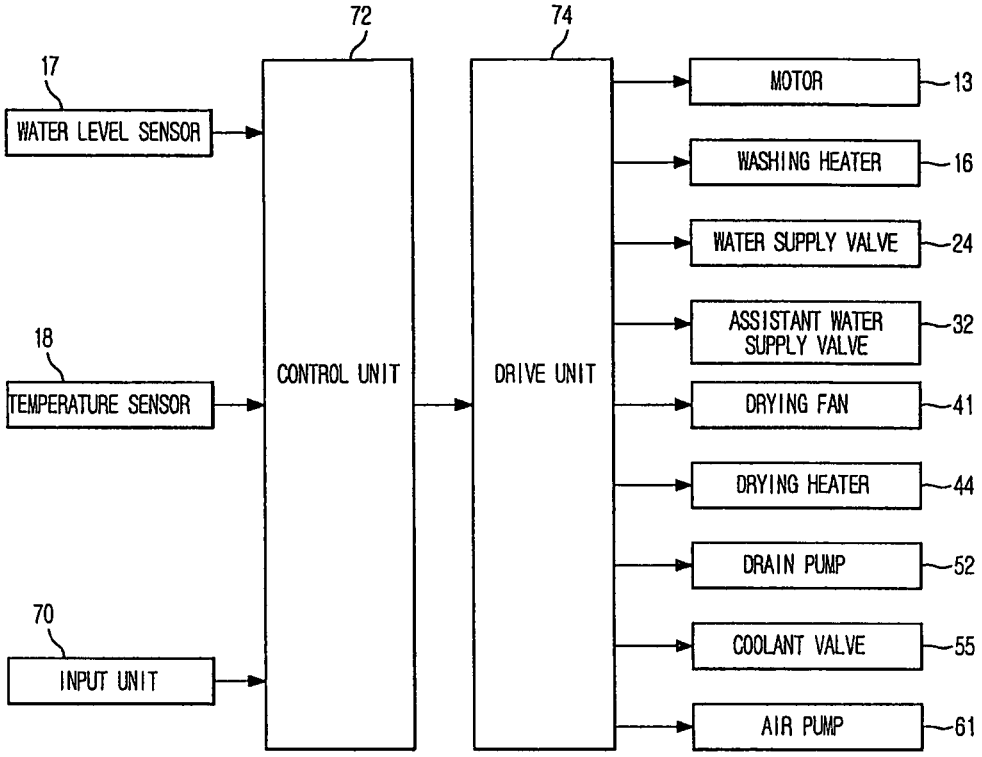
FIG. 2 is a block diagram illustrating the operational structure of the washing machine according to the embodiment of the present invention.

FIG. 2 shows the operational structure of the washing machine according to embodiments of the present invention. Besides the parts described with reference to FIG. 1, the washing machine according to the embodiment of the present invention further comprises an input unit 70, a control unit 72, and a drive unit 74.

The input unit 70 enables the user to input a washing course, for example general washing, delicate washing or the like, selected according to the type of laundry. Additionally, through the input unit 70, the user inputs to the control unit 72 operational data such as a washing temperature set as desired (hereinafter, referred to as 'set temperature'), a dehydrating rpm, and an additional rinsing.

The control unit 72, as a microcomputer (micom), controls operation of the washing machine in accordance with the operational data input through the input unit 70. The control unit 72 stores data including a motor rpm set according to weight of the laundry in the selected washing course, a foaming operation rate, that is, an on/off rate of the air pump 61, and a washing time.

During the foam washing, the control unit 72 controls the foaming operation of the air pump 61 and the heating operation of the washing heater 16 which are alternately performed, controls the motor rpm and the foaming operation rate according to the laundry weight, and controls starting of the foaming operation and stopping of the heating operation according to the water level provided to the control unit 72 by the water level sensor 17, or the water temperature provided to the control unit 72 by the temperature sensor 18. By thus controlling the motor 13, the washing heater 16, and the air pump 61, the control unit 72 can optimize the washing efficiency, while preventing damage to the laundry material.

The drive unit 74 receives operation controlling signals from the control unit 72 and accordingly operates and stops the motor 13, the washing heater 16, the water supply valve 24, the assistant water supply valve 32, the drying fan 41, the drying heater 44, the drain pump 52, the coolant valve 55, and the air pump 61.

Hereinafter, the operational process and effects of the above-structured washing machine and the controlling method thereof will be described.

Figure 3A:
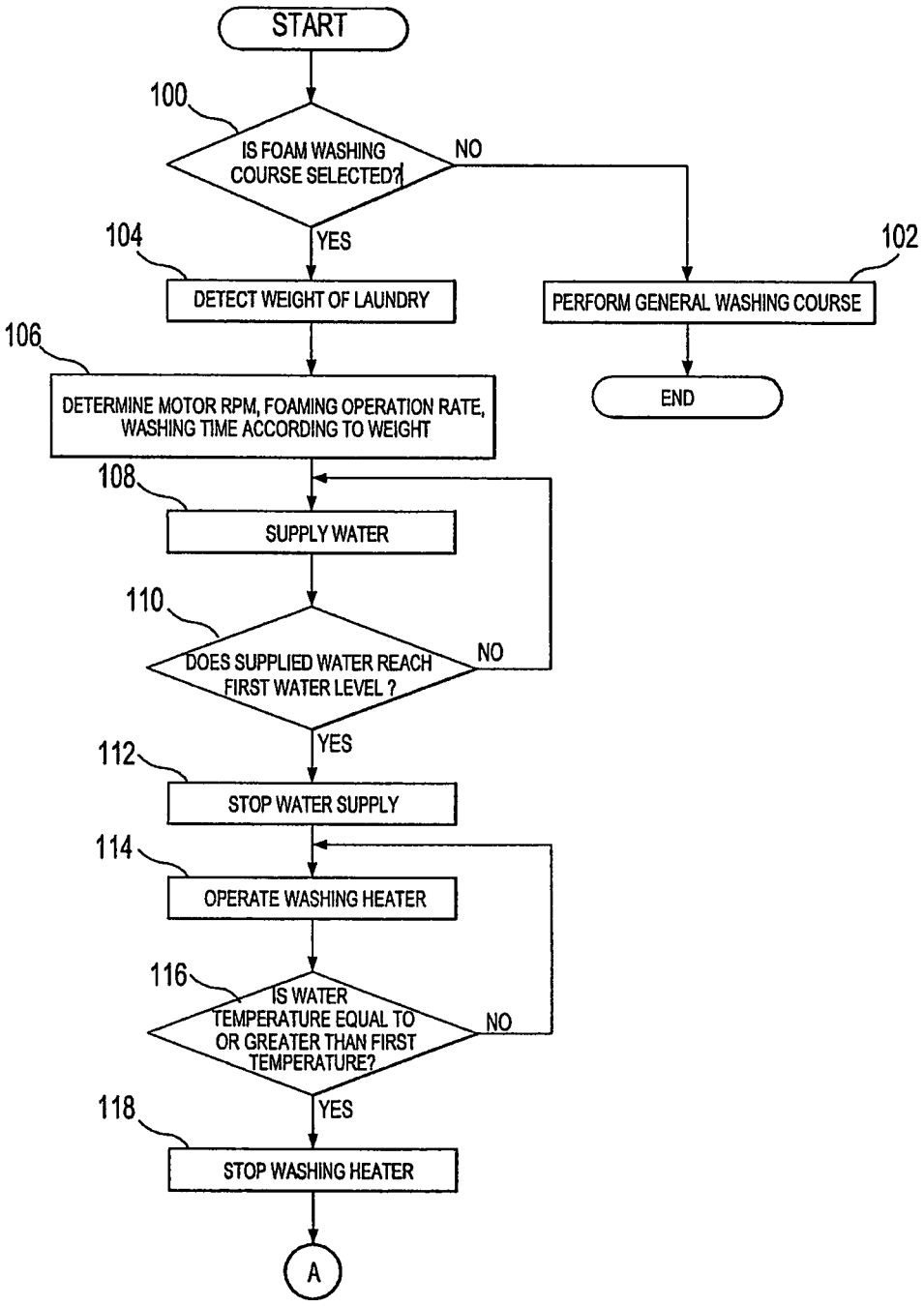
FIGS. 3*a* and 3*b* are a serial flowchart illustrating the sequential operations to control foam washing in the washing machine according to the embodiment of the present invention.
Figure 3B:
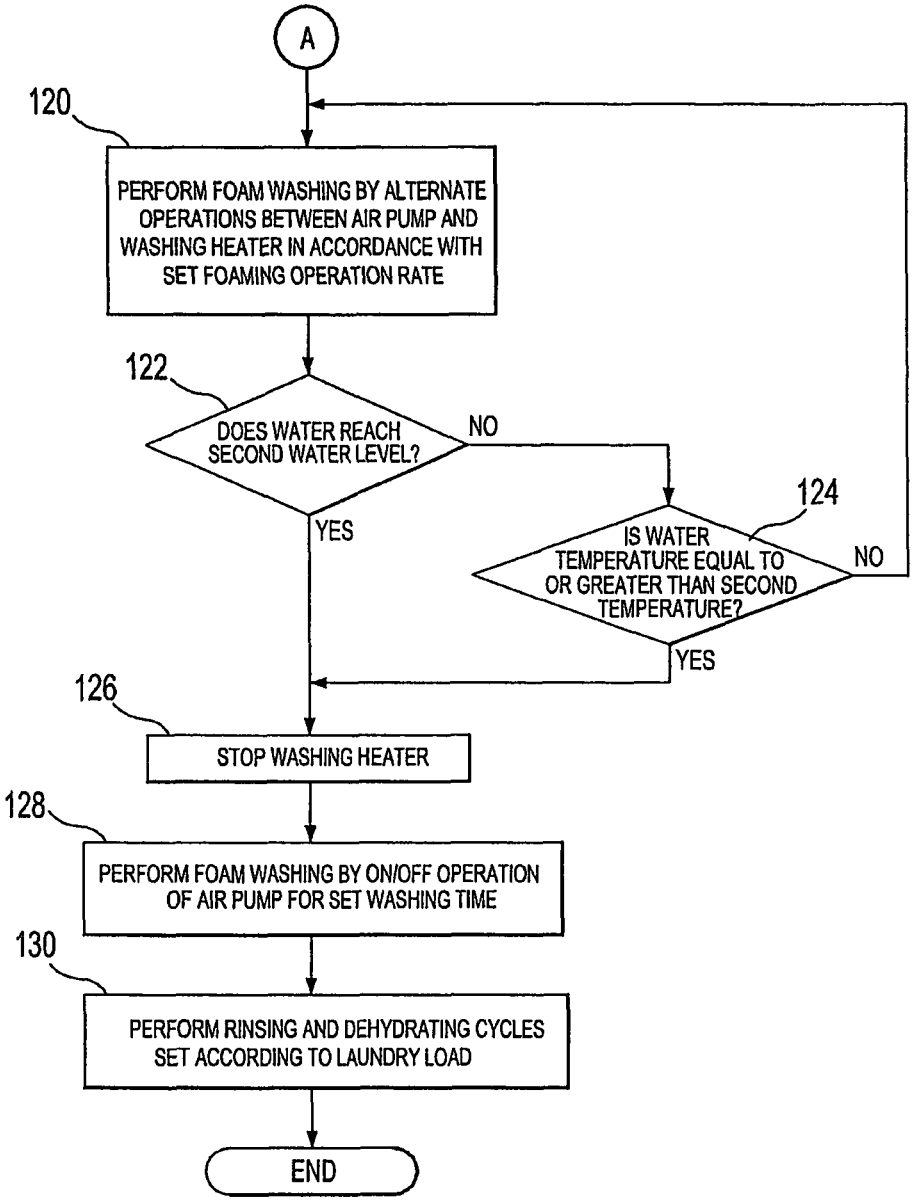

FIGS. 3*a* and 3*b* are serial flowcharts illustrating the sequential operations to control foam washing in the washing machine according to embodiments of the present invention. Especially, FIGS. 3*a* and 3*b* are related to a foam washing course that washes laundry by detergent foam.

Referring first to FIGS. 1, 2 and 3*a*, when the user puts the laundry in the rotary drum 12 and selects the foam washing course, the user-selected operational data is input to the control unit 72 through the input unit 70.

The control unit 72 determines in accordance with the input data whether the user selected the foam washing course (operation 100). When, a user-selected course is not the foam washing course, the control unit 72 orders the washing machine to perform a general washing course in a conventional way (operation 102).

When the user-selected course is the foam washing course, the control unit 72 detects the weight of the laundry input into the rotary drum 12 (operation 104) and according to the detected weight, sets the amount of washing water, the motor rpm, the foaming operation rate (on/off rate of the air pump 61), and the washing time (operation 106).

Next, the control unit 72 controls the water supply valve 24 and the assistant water supply valve 32 to supply high-concentration detergent water required for generation of foam, such that the washing water is supplied to the water tub 11 passing through the water supply pipe 22 and the detergent supply device 19. Here, the detergent in the detergent supply device 19, as being dissolved by the supplied washing water, is supplied to the water tub 11 along with the washing water by passing through the connection pipe 26 and the water supply nozzle 28. Therefore, the detergent water is supplied to the lower part of the water tub 11, more specifically, the space between the water tub 11 and the rotary drum 12 (operation 108).

As the washing water with the detergent is supplied to the water tub 11, the detergent water, which is the mixture of the washing water and the detergent, is produced between the water tub 11 and the rotary drum 12. At this time, the water level sensor 17 detects whether the water level of the detergent water is the preset first water level which is the maximum level not causing overflow of water into the rotary drum 12 (about ¼ of a water level of the general washing) (operation 110).

When the water level is not the first water level, detergent water is supplied until the detergent water reaches the first water level. When the detergent water reaches the first water level, the control unit 72 cuts off the water supply valve 24 and the assistance water supply valve 32 to stop the supply of the detergent water (operation 112).

During the water supply, the motor 13 is operated according to the present motor rpm and the operation rate and kept in operation afterwards. Therefore, the operation of the motor 13 will not be dedicatedly explained.

Next, the washing heater 16 is operated to heat the detergent water up to the temperature appropriate for generating foam, so that the laundry in the rotary drum 12 can be washed using the foam (operation 114).

Here, since the water amount supplied to the space between the water tub 11 and the rotary drum 12 is less than in general washing, the washing heater 16 is able to heat up the detergent water faster as much. As a result, the whole washing time can be reduced, also saving the energy for heating the water.

The temperature sensor 18 detects whether temperature of the detergent water heated by the washing heater 16 is the preset first temperature at which foam is efficiently generated (approximately 30° C.) (operation 116).

When the water temperature is not the first temperature, the detergent water is continuously heated by the washing heater 16 up to the first temperature. When the detergent water reaches or exceeds the first temperature, the control unit 72 determines the temperature of the detergent water to be appropriate for the foaming operation and therefore stops the washing heater 16 (operation 118).

When the detergent water is properly heated, the control unit 72 starts the foaming operation by controlling the air pump 61 depending on the foaming operation rate as set.

The foaming operation is performed, more specifically, in such a manner that the air is passed through the air supply pipe 62 in accordance with the operation of the air pump 61, passed through the porous block 63 and then distributed. The distributed air is introduced in the space between the water tub 11 and the rotary drum 12 through the air holes 64, and generates air bubbles in the properly heated detergent water. As a consequence, the detergent foam is produced.

Although the porous block 63 is used for the foaming operation in one or more embodiments, other embodiments of the present invention may not be limited to this method. Any other structures capable of producing detergent foam may be adopted.

The foam generated between the water tub 11 and the rotary drum 12 are put into the rotary drum 12 through holes 12*a* or the front side of the rotary drum 12. It takes a predetermined time, for example, 3 minutes, for the foam put in the rotary drum 12 to be evenly distributed through the inside of the rotary drum 12. Therefore, washing of the laundry can be performed with only the foam.

Together with the foam of high-concentration detergent distributed in the rotary drum 12, rotation of the rotary drum 12 enhances the washing performance by promoting separation of dirt of the laundry. While the laundry is rising and falling by the operation of the rotary 12, the foam serve as a cushion, thereby restraining damage of the laundry by such friction.

During the foam washing, although the first temperature of the water is maintained by the generated foam, the temperature of the foam being distributed through the rotary drum 12 decreases, thereby deteriorating transmission of the foam temperature into the laundry.

Referring now to FIGS. 1, 2 and 3*b*, to solve this problem, according to embodiments of the present invention, the washing heater 16 is operated alternately with the air pump 61 so as to improve heat transmission from the foam into the laundry. For example, when the foaming operation is off, in other words, when the air pump 61 is off, the washing heater 16 is operated. Conversely, when the foaming operation is on, in other words, when the air pump 61 is on, the washing heater 16 is stopped (operation 120).

By such alternate operations, the optimal temperature for the foaming operation and the temperature of the heated foam can be effectively transmitted into the laundry without loss. Consequently, washing efficiency can be optimized.

Afterwards, as the foam washing proceeds, the amount of the detergent water gradually decreases. The water level sensor 17 detects whether the decreasing water level of the detergent water reaches the second water level at which only the washing heater 16 is submerged (operation 122).

When the water level is not the second water level, the temperature sensor 18 detects the temperature of the detergent water heated by the alternate foaming and heating operations, and determines whether the temperature is the preset second temperature which is the maximal temperature for efficient heat transmission (operation 124).

When the water temperature is less than the second temperature, the foam washing continues with the alternate foaming operation and heating operation, until the water temperature reaches the second temperature or until the water level reaches the second water level. When the water temperature reaches or exceeds the second temperature, the control unit 72 determines the detergent water to be properly heated to the temperature appropriate for generating and maintaining the foam (operation 126).

As a result of detection in operation 122, if the water level is the second water level, the washing heater 16 is stopped (operation 126). Afterwards, only the air pump 61 generates foam and the foam washing is continued for a predetermined time (operation 128).

After completing the foam washing course, rinsing and dehydrating cycles are performed as set according to the laundry weight (operation 130).

As apparent from the above description, the present invention provides a washing machine and a controlling method thereof, capable of achieving optimal washing efficiency, by maintaining the maximal water temperature through alternate foaming and heating operations and thereby efficiently transmitting the temperature of the heated foam.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing control method for a washing machine, comprising:

supplying washing water until a level of the washing water reaches a target water level, and subsequently operating a heating device to heat the washing water;

operating a foaming device, to generate foam;

stopping the heating device when a temperature of the washing water reaches a first temperature; and washing, using the foam, while alternating heating of the washing water until the temperature of the washing water reaches a second temperature after reaching the first temperature, wherein the alternating heating of the washing water comprises operating the heating device alternately with the operation of the foaming device so that heat from the washing water is transmitted to the generated foam.

2. The washing control method according to claim 1, wherein the operating the heating device comprises operating the heating device to continuously heat the washing water until the temperature of the washing water reaches the first temperature.

3. The washing control method according to claim 2, wherein the operating foaming device, to generate form, comprises:

setting a foaming operation rate according to weight of the laundry, and controlling an on/off operation of the foaming device in accordance with the set foaming operation rate to thereby generate foam.

4. The washing control method according to claim 1, wherein the washing laundry, using the foam, comprises:

heating the washing water through the alternate operations of the foaming and heating devices; and washing the laundry while transmitting heat from the washing water to the generated foam until the temperature of the heated washing water reaches the second temperature.

5. The washing method according to claim 4, wherein, the washing laundry, using the foam, further comprises:

stopping the heating device when the temperature of the washing water reaches the second temperature, and performing the foam washing only through the operation of the foaming device.

6. The washing control method according to claim 5, wherein the second temperature is higher than the first temperature.

7. The washing control method according to claim 4, further comprising:

detecting a water level of the washing water heated through the alternate operations of the foaming device and the heating device.

8. The washing control method according to claim 7, wherein the washing laundry, using the foam, comprises:

washing the laundry while transmitting the heat from the washing water to the generated foam through the alternate operations of the foaming and heating devices until the water level of the washing water reaches a heater-safe water level.

9. The washing control method according to claim 8, wherein the washing laundry, using the foam, further comprises:

stopping the heating device when the water level of the washing water reaches the heater-safe water level, and performing the foam washing only through the operation of the foaming device.

10. A washing control method for a washing machine, comprising:

supplying, to a space between a water tub and a drum, washing water required to generate foam;

stopping the supply of washing water when a level of the washing water reaches a target water level, and then operating a heating device to heat the washing water;

operating a foaming device, to generate foam;

stopping the heating device when a temperature of the washing water reaches a first temperature; and washing, using the foam while alternating heating of the washing water until the temperature of the washing water reaches a second temperature after reaching the first temperature, wherein the alternating heating of the washing water comprises operating the heating device alternately with the operation of the foaming device so that heat from the washing water is transmitted to the generated foam.

11. The washing control method according to claim 10, wherein the operation of the heating device is performed until the temperature of the washing water reaches a preset temperature.

12. The washing control method according to claim 11, wherein the heating device is stopped when the washing water reaches a heater safe water level.

* * * * *